US006663212B2

(12) United States Patent
Kojima

(10) Patent No.: US 6,663,212 B2
(45) Date of Patent: Dec. 16, 2003

(54) INK JET DEVICE THAT EJECTS INK DROPLETS HAVING DIFFERENT VOLUMES

(75) Inventor: Masatomo Kojima, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/127,663

(22) Filed: Apr. 23, 2002

(65) Prior Publication Data

US 2002/0158927 A1 Oct. 31, 2002

(30) Foreign Application Priority Data

Apr. 25, 2001 (JP) ..... 2001-128104

(51) Int. Cl.[7] ..... B41J 29/38
(52) U.S. Cl. ..... 347/17; 347/9
(58) Field of Search ..... 347/11, 9

(56) References Cited

U.S. PATENT DOCUMENTS 5,402,159 A 3/1995 Takahashi et al. ..... 347/9
5,914,731 A * 6/1999 Yano et al. ..... 347/9
5,980,013 A * 11/1999 Takahashi ..... 347/14
6,154,228 A * 11/2000 Okuda et al. ..... 347/15
6,350,003 B1 2/2002 Ishikawa

FOREIGN PATENT DOCUMENTS

JP A 3-274159 12/1991 ..... B41J/2/045
JP 11-170515 6/1999

* cited by examiner

*Primary Examiner*—Judy Nguyen
*Assistant Examiner*—Alfred E. Dudding
(74) *Attorney, Agent, or Firm*—Oliff & Berridge, PLC

(57) ABSTRACT

Three types of ink droplets of increasing volume are ejected from a single nozzle. Because ejection speed decreases as the volume of the ink droplet decreases, a smaller ink droplet will take a longer flight time to reach a recording sheet than a large ink droplet. Ejecting the smaller ink droplet at a timing earlier than the larger ink droplet can control the impact position of the smaller ink droplet, thereby preventing displacement of impact position on the recording sheet.

8 Claims, 4 Drawing Sheets

| | P1 | P2 | P3 |
|---|---|---|---|
| EJECTION SPEED (m/s) | 7.0 | 6.5 | 6.0 |
| VOLUME (pl) | 10 | 6 | 4 |
| AMOUNT OF SHIFT (μm) | 0 | 10 | 22 |

| | | P2 | P3 |
|---|---|---|---|
| 1 | TIME DIFFERENCE (μsec) | 4 | 10 |
| | AMOUNT OF SHIFT (μm) | 7 | 14 |
| 2 | TIME DIFFERENCE (μsec) | 8 | 15 |
| | AMOUNT OF SHIFT (μm) | 4 | 10 |
| 3 | TIME DIFFERENCE (μsec) | 13 | 29 |
| | AMOUNT OF SHIFT (μm) | 0 | 0 |

INK JET DEVICE THAT EJECTS INK DROPLETS HAVING DIFFERENT VOLUMES

BACKGROUND OF THE INVENTION

1. Field of the Invention

The present invention relates to an ink jet device including an actuator that ejects ink droplets by changing an internal pressure of a pressure chamber.

2. Related Art

There has been known a piezoelectric type ink jet printer head including a cavity plate formed with a pressure chamber and a piezoelectric element positioned adjacent to the pressure chamber. In this type of printer head, an ink droplet is ejected from the pressure chamber when a driving pulse is applied to the piezoelectric element. The rising edge of the driving pulse displaces the piezoelectric element, thereby increasing the volume of the pressure chamber. This volume change decreases an internal pressure of the pressure chamber, and a resultant negative pressure is maintained for a predetermined time, which is equal to the pulse width of the driving pulse, so that ink is introduced into the pressure chamber from a manifold. Then, the lowering edge of the driving pulse releases the displacement of the piezoelectric element, whereby the increased volume of the pressure chamber is restored. This increases the internal pressure of the pressure chamber and ejects an ink droplet through a nozzle onto a recording sheet, which is being transported relative to the printer head.

The pulse width of the driving pulse determines the amount of pressure that contributes to ink ejection, which in turn determines the volume of the ink droplet. Because a color-scale of resultant images is determined by the volume of ejected ink droplet, it is possible to obtain a desired color-scale by controlling the pulse width.

SUMMARY OF THE INVENTION

However, when a driving pulse with a different pulse width is applied in order to change the volume of ink droplets, the ejection speed of these ink droplets also differs, because the pulse width determines a timing at which the pressure change inside the pressure chamber is superimposed on a pressure that restores the deformed condition of the piezoelectric element. When ink droplets are ejected based on predetermined timing-clock signals at different ejection speeds toward a recording sheet that is moving relative to the printer head, impact positions of these ink droplets on the recording sheet will be out of alignment, adversely affecting quality of resultant image.

It is an objective of the present invention to overcome the above problems, and also to provide an ink jet device capable of forming dots on desired positions even when the volume of ejected ink droplets varies.

In order to achieve the above and other objects, there is provided an ink ejection device including a cavity plate formed with a pressure chamber and a nozzle, an actuator that fluctuates an internal pressure of the pressure chamber to eject an ink droplet from the nozzle onto a recording medium, and a driving unit that selectively outputs a driving signal to the actuator. The actuator fluctuates the internal pressure in response to the driving pulse. The driving unit outputs the driving signal for ejecting a smaller ink droplet at a first timing earlier than a second timing for a larger ink droplet.

BRIEF DESCRIPTION OF THE DRAWINGS

In the drawings:

FIG. 4(*b*) is a second pulse signal used in the ink jet head;

FIG. 4(*c*) is a third pulse signal used in the ink jet head;

FIG. 8(*b*) is a plan view showing an output timing of the second-pulse signal; and FIG. 8(*c*) is a plan view showing an output timing of the third pulse signal.

PREFERRED EMBODIMENT OF THE PRESENT INVENTION

Next, an ink jet device according to an embodiment of the present invention will be described while referring to the attached drawings. The ink jet device of the present embodiment is applied to an ink jet head 1 shown in FIG. 1.

Figure 1:
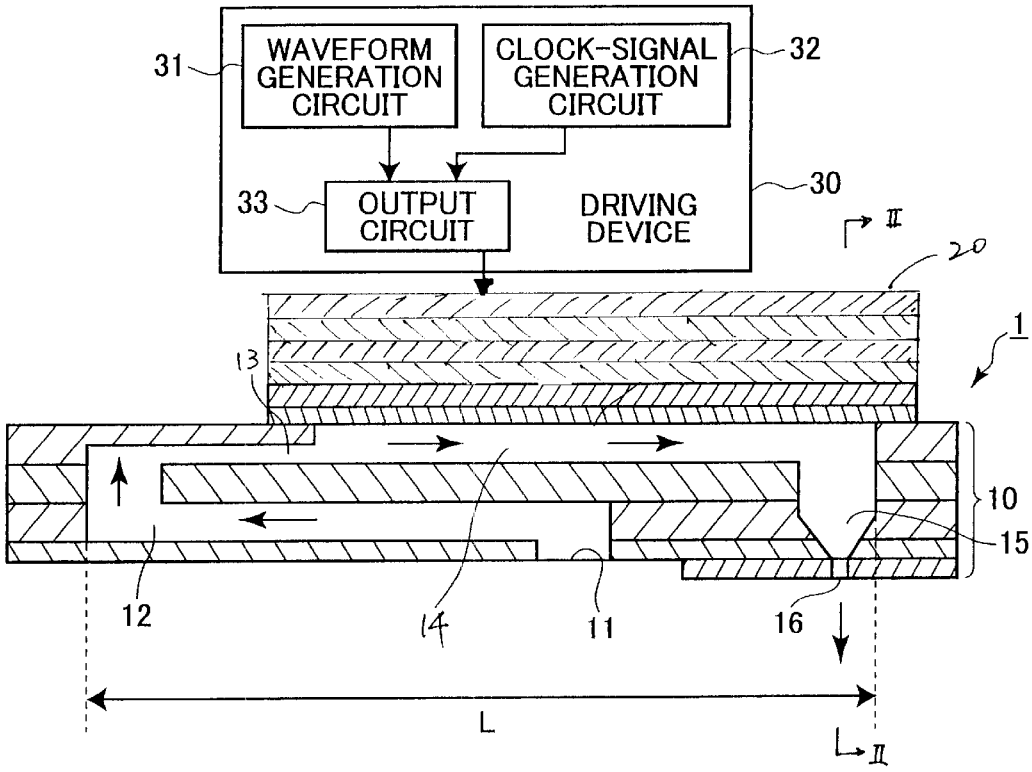
FIG. 1 is a cross-sectional view with a block diagram showing an ink jet head according to an embodiment of the present invention.

As shown in FIG. 1, the ink jet head 1 includes a cavity plate 10, a piezoelectric actuator 20, and a driving device 30. The cavity plate 10 is formed with an ink supply port 11, a manifold 12, a plurality of pressure chambers 14, and a plurality of nozzles 16. The ink supply port 11 is in a fluid communication with an ink supply source (not shown) and also with the manifold 12. The pressure chambers 14 are fluidly connected to the manifold 12 via corresponding restrictors 13. The nozzles 16 are in one-to-one correspondence with and fluidly connected to the pressure chambers 14 via ports 15.

The cavity plate 10 is formed, for example, of a plurality of 42% nickel alloy plates (42 alloy) with about 50 $\mu$m to 150 $\mu$m thickness. These plates are laminated one on the other and fixed by an adhesive. Alternatively, the cavity plate 10 could be formed of resin.

Figure 2:
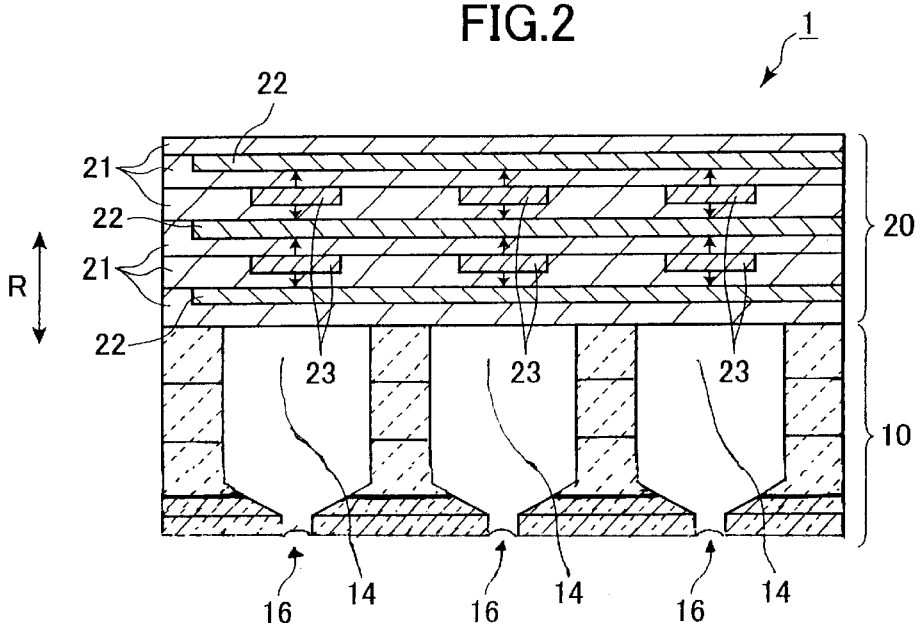
FIG. 2 is a cross-sectional view of the ink jet head taken along a line II—II of FIG. 1.

The piezoelectric actuator 20 is attached to the cavity plate 10 and has a configuration similar to that disclosed in Japanese Patent Application Publication No. HEI-3-274159. Namely, as shown in FIG. 2, the actuator 20 includes a plurality of piezoelectric sheets 21, a plurality of internal negative electrodes 22, and a plurality of internal positive electrodes 23, which are laminated in such a manner that each piezoelectric sheet 21 is sandwiched and fixed by an adhesive between each internal negative electrode 22 and corresponding internal positive electrodes 23. The internal positive electrodes 23 are aligned with the corresponding pressure chambers 14 in a lamination direction R. When a voltage is applied between the internal negative electrode 22 and the internal positive electrode 23, bias electric field is in turn developed across the piezoelectric sheet 21 positioned between these electrodes 22, 23. As a result, corresponding portion of piezoelectric sheet 21 deforms in the lamination direction R due to piezoelectric effect, whereby the volume of the corresponding pressure chamber 14 is reduced, so that the internal pressure thereof decreases. In the present embodiment, the voltage is applied to the electrode 22, 23 in constant, so that the reduced volume of the pressure chambers 14 is maintained as the normal condition.

As shown in FIG. 1, the driving device 30 includes a waveform generation circuit 31, a clock-signal generation circuit 32, and an output circuit 33. The waveform generation circuit 31 stores a plurality of waveform signals each for different ink-droplet volume, and outputs the waveform signals as needed. The clock-signal generation circuit 32 is for generating clock signals that determine ink-ejection timings based on relative movement of the ink jet head 1 and the recording sheet. The output circuit 33 is for generating driving pulse signals based on the waveform signals output from the waveform generation circuit 31 and for outputting the driving pulse signals to the piezoelectric actuator 20 based on the clock signals.

In the present embodiment, the driving pulse is selectively applied across the electrodes 22, 23 in the condition where the reduced volume of the pressure chamber 14 is maintained. The lowering edge of the applied driving pulse releases the displacement of the piezoelectric sheets 14, whereby the volume of the pressure chamber 14 is restored, that is, increased to its initial volume, resulting in a negative pressure generated in the pressure chamber 14. This negative pressure is maintained for a duration of time T corresponding to a duration of time required for a pressure wave to propagate once across the length of the pressure chamber 14. During the time duration T, ink is supplied into the pressure chamber 14 from the manifold 12.

The duration of time T can be calculated by the following formula:

$$T=L/a$$

wherein L is the length of the pressure chamber 14 (FIG. 1); and a is the speed of sound through the ink filling the pressure chamber 14.

Theories on pressure wave propagation teach that at the moment the duration of time T elapses after the lowering edge of the driving pulse, the pressure in the pressure chamber 14 inverts to a positive pressure. The rising edge of the driving pulse applies the voltage to the driving electrodes in synchronization with this inversion so that the volume of the pressure chamber 14 reverts to the reduced volume.

The pressure generated when the volume of the pressure chamber 14 is reduced is added to the inverted positive pressure so that a relatively high pressure is generated in the nozzle 16. This relatively high pressure ejects an ink droplet from the nozzle 16.

The pulse width of the driving pulse is set equal to the time duration T or as an odd integer times the time duration T. Otherwise, the pressure contributing to the ink ejection will decrease, resulting in smaller ink-droplet volume and lower ink ejection speed.

Next, ink-ejection operation according to the present embodiment will be described while referring to a specific example. In this example, the ink jet head 1 is attached to a carriage of an ink jet printer (not shown), which moves at a speed of 762 mm/s. The distance between the nozzle 16 and the recording sheet is set to 1.2 mm. Ink droplets with different volumes are ejected through the same nozzle 16. The time duration T is 6 μsec.

Figure 3:
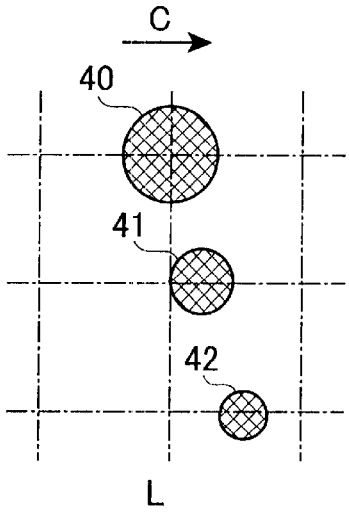
FIG. 3 is a plan view showing the size and the impact position of three ink droplets ejected at the same timing.
Figure 4A:
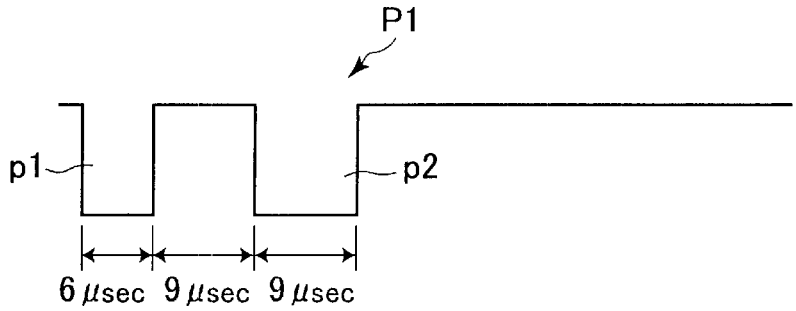
FIG. 4(*a*) is a first pulse signal used in the ink jet head of the present embodiment.
Figure 4B:
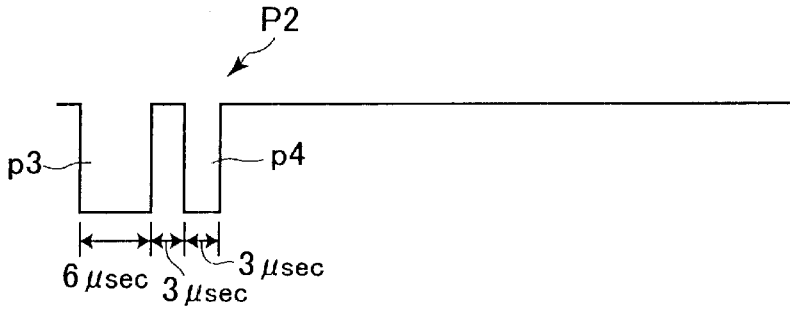
Figure 4C:
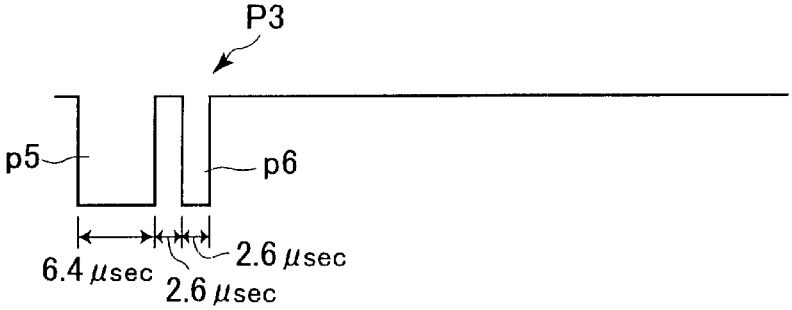

As shown in FIG. 3, three types of ink droplets are ejected in this example, that is, ink droplets 40, 41, and 42 having a larger volume in this order. FIGS. 4(*a*), 4(*b*), 4(*c*) show waveforms of driving pulse signals P1, P2, P3 for ejecting the ink droplets 40, 41, 42, respectively.

The waveform of the first pulse signal P1 includes an ejection pulse p1 followed by a cancel pulse p2 with 9 μsec time interval therebetween. The ejection pulse p1 is for ejecting the ink droplet 40, and has a pulse width of 6 μsec, which equals to the time duration T. The cancel pulse p2 has a pulse width of 9 μsec. The cancel pulse p2 is for reducing residual pressure fluctuation in the pressure chamber 14 after the ink droplet 40 is ejected in response to the ejection pulse p1. Specifically, the lowering edge of the cancel pulse p2 decreases the internal pressure in synchronization with the timing of when the residual pressure inverts to a positive pressure. On the other hand, the rising edge of the cancel pulse p2 increases the internal pressure when the residual pressure is relatively low.

The waveform of the second pulse signal P2 includes an ejection pulse p3 followed by a downsizing pulse p4 with a 3 μsec time interval therebetween. The ejection and downsizing pulses p3 and p4 have a pulse width of 6 μsec and 3 μsec, respectively. The downsizing pulse p4 makes the volume of an ink droplet small by pulling a portion of ejected ink back into the pressure chamber 14. That is, immediately after ink is ejected through the nozzle 16 in response to the ejection pulse p3, the ejected ink is not yet separated from remaining ink inside the pressure chamber 14. In this condition, the downsizing pulse p4 generates a negative pressure inside the pressure chamber 14, whereby a portion of the ink that is ejected but not completely separated is draw back into the pressure chamber 14. Afterwards, remaining portion of the ejected ink is separated from the ink inside the pressure chamber 14 and forms the ink droplet 41 having a reduced volume.

The waveform of the third pulse signal P3 includes an ejection pulse p5 followed by a downsizing pulse p6. The downsizing pulse p6 has a pulse width of 2.6 μsec, and there is a 2.6 μsec time interval between the pulses p5 and p6. A pulse width of the ejection pulse p5 is 6.4 μsec, which is not equal to nor an odd integer times the time duration T. Such a pulse width of the ejection pulse p5 decreases the volume of resultant ink droplets. The downsizing pulse p6 further decreases the volume of ejected ink droplets in the same manner as the downsizing pulse p4. Moreover, because the time interval between the ejection pulse p5 and the downsizing pulse p6 is as small as 2.6 μsec, relatively large portion of ink is draw back into the pressure chamber 14, thereby reducing the volume even further and generating the ink droplet 42.

Here, the negative pressure generated by the cancel pulses P2, P3 reduces the ejection speed of the ink droplets 41, 42 as well as reducing their volume. In addition, the ejection speed of the ink droplet 42 is further reduced due to the pulse width of the ejection pulse p5. As a result, the ink droplets 40, 41, 42 of the present example have the volume of 10 pl, 6 pl, 4 pl, respectively, and the ejection speed of 7.0 m/s, 6.5 m/s, and 6.0 m/s, respectively.

Figures 5, 6, 7:
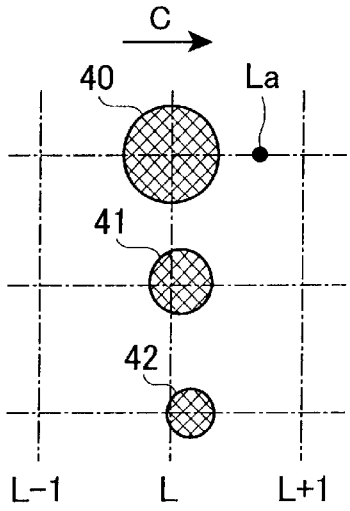
FIG. 5 is a table showing relationships among ejection speeds, volumes, and amounts of shift for each ink droplet.
FIG. 6 is a table showing relationships between ejection timings and amounts of shift for each ink droplet.
FIG. 7 is a plan view showing the impact position of ink droplets ejected in response to pulse signals output at adjusted timings.

Because the ink droplets 40, 41, 42 have different ejection speeds, if these ink droplets 40, 41, 42 are all ejected at the same timing, the impact positions of the ink droplets 40, 41, 42 will be out of alignment and will greatly shift as shown in FIG. 3. FIG. 5 shows resultant amounts of shift of the ink droplets 40, 41, 42 from a target position. Here, the target position is where the ink droplet 40 ejected in response to the first pulse signal P1 that is output at reference timing will impact. The amount of shift is a distance between a center of the target position and a center of the actual impact position with respect to a direction C in which the recording sheet moves relative to the ink jet head 1.

Figure 8A:
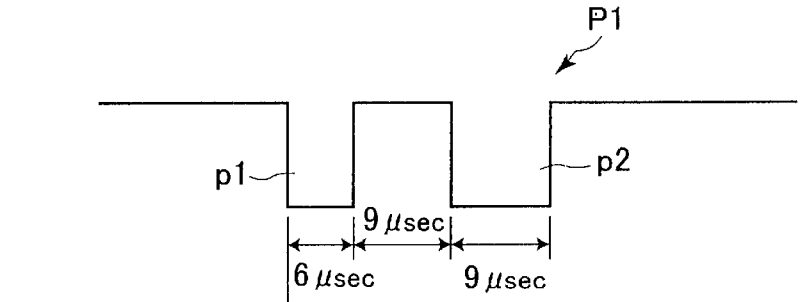
FIG. 8(*a*) is a plan view showing an output timing of the first pulse signal.
Figure 8B:
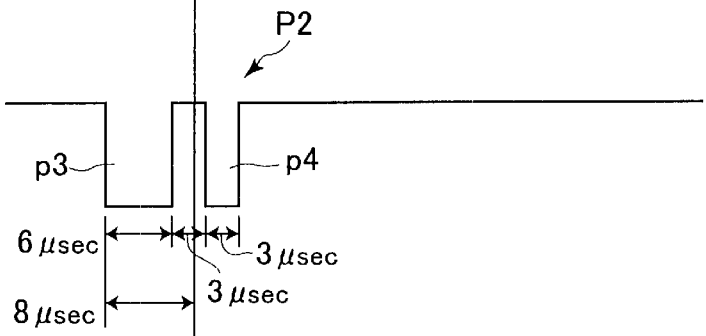
Figure 8C:
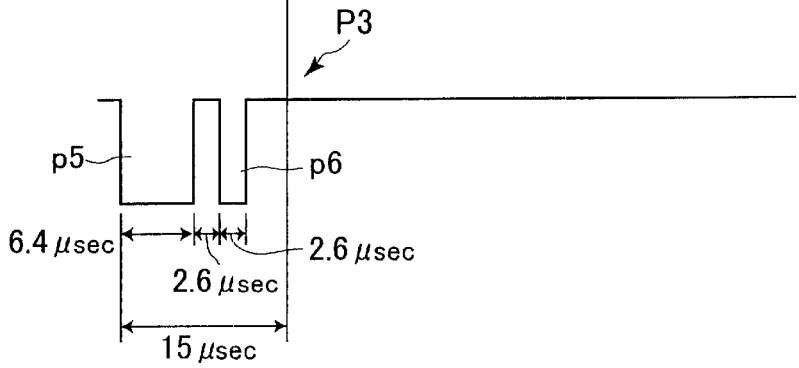

In the present embodiment, the impact positions of the ink droplets 41 and 42 are adjusted by controlling the output timings of the corresponding second and third pulse signals P2 and P3 in the following manner. That is, as shown in FIGS. 8(*a*) to 8(*c*), the output timing of the first pulse signal P1 is set as reference timing, and the output timing of the second pulse signal P2 is set 8 μsec earlier than the reference timing. The output timing of the third pulse signal P3 is set 15 μsec earlier than the reference timing. The reason for this will be described below.

As mentioned above, the ejection speed decreases as the volume of the ink droplet decreases. This means that a smaller ink droplet will take a longer time (flight time) to reach the recording sheet than a larger ink droplet. Therefore, ejecting the smaller ink droplet at a timing earlier than the larger ink droplet can control the impact position of the smaller ink droplet. Here, a time difference t (μsec) between the flight time of the smaller ink droplet and the flight time of the larger ink droplet is calculated in the following formula:

$$t=g(1/V1-1/V2)\times 1000$$

wherein, g(mm) is the distance between the nozzle 16 and the recording sheet, which is 1.2 mm in this example;

V1 (m/s) is an ejection speed (velocity) of the smaller ink droplet; and

V2 (m/s) is an ejection speed (velocity) of the larger ink droplet.

Using the above formula, the time difference t between the flight time of the ink droplet 41 (6.5 m/s ejection speed) and the flight time of ink droplet 40 (7.0 m/s ejection speed) is calculated to be 13 μsec. Accordingly, ejecting the ink droplet 41 at timing 13 μsec earlier than the ink droplet 40 will minimize the amount of shift of the ink droplet 41. This can be accomplished by outputting the second pulse signal P2 at timing 13 μsec earlier than the reference timing.

Similarly, the time difference t between the flight time of the ink droplet 42 (6.0 m/s ejection speed) and the flight time of the ink droplet 40 (7.0 m/s ejection speed) is calculated to be 29 μsec based on the above formula. Accordingly, ejecting the ink droplet 42 29 μsec earlier than the ink droplet 40 will minimize the amount of shift of the ink droplet 42. This can be accomplished by outputting the third pulse signal P3 at timing 29 μsec earlier than the reference timing.

Needless to say, the first pulse signal P1 is output at the reference timing.

FIG. 6 shows the above relationships between the output timings and the amounts of shift. Here, shifting the output timings of the pulse signals P2, P3 while maintaining a high frequency of clock signals will cause a problem. That is, as shown in FIG. 7, in order to form a dot on a scan line L+1 with the ink droplet 42, it is necessary to output the corresponding third pulse signal P3 at a relatively early timing, for example, when the nozzle 16 reaches a position La shown in FIG. 7. Accordingly, if a dot has been formed on a scan line L with the ink droplet 40 ejected from the same nozzle 16, then the time interval between the first pulse signal P1 and the third pulse signal P3 will be too small to give a time to reduce enough the residual pressure of the first pulse signal P1. As a result, the residual pressure will undesirably affect the subsequent ejection of the ink droplet 42.

Accordingly, the frequency of the clock signals must be set not to cause interference between the first pulse signal P1 and the following third pulse signal P3 and to put a time interval sufficient for preventing the residual pressure of the first pulse signal P1 from interfering the subsequent ejection of the ink droplet 42.

On the other hand, it is unnecessary to achieve the exact and complete target impact positions. Slight displacement of impact positions will hardly affect resultant image quality and so is tolerable. Therefore, it is possible to change the output timings of the second and third pulse signals P2, P3 to be later than the above calculated theoretical timings as long as it is tolerable. This increases the frequency of the clock signals and achieves a higher print speed.

As shown in FIG. 6, when the output timing of the second pulse signal P2 is set 4 μsec earlier than the reference timing, the amount of shift of the ink droplet 41 is 7 μm. Also, when the output timing of the third pulse signal P3 is set 10 μsec earlier than the reference timing, the amount of shift of the ink droplet 42 is 14 μm. However, these amounts of shift are small enough not to cause any significant effect on image quality.

When the output timing of the second pulse signal P2 is set 8 μsec earlier than the reference timing, the amount of shift of the ink droplet 41 is 4 μm. When the output timing of the third pulse signal P3 is set 15 μsec earlier than the reference timing, the amount of shift of the ink droplet 42 is 10 μm. These amounts of shift are still small enough not to cause any significant effect on image quality.

FIG. 7 shows the impact positions of ink droplets 40, 41, 42 where the amounts of shift of the ink droplets 41 and 42 are 4 μm and 10 μm, respectively. It is apparent from FIG. 7 that these amounts of shift hardly affect the image quality. Accordingly, as shown in FIGS. 8(*a*) to 8(*c*), the output timings of the second and third pulse signals P2 and P3 are set 8 μm and 15 μm earlier than the reference timing, respectively.

In this manner, the output timings of the pulse signals P1, P2, and P3 are controlled in order to provide a high quality image even when ink droplets with different volumes are used.

While some exemplary embodiments of this invention have been described in detail, those skilled in the art will recognize that there are many possible modifications and variations which may be made in these exemplary embodiments while yet retaining many of the novel features and advantages of the invention.

For example, in the above embodiment the output timing of the first pulse signal P1 is set as the reference timing, and output timings of the second and third pulse signals P2 and P3 are shifted forward with respect to the reference timing. However, the output timing of the third pulse signal P3, which is output at a latest timing, could be set as a reference timing, and the output timings of the first and second pulse signals P1 and P2 could be set later than the reference timing. Still alternatively, the output timing to form a dot on a previous scan line could be set as a reference timing, and the output timings of all the pulse signals P1, P2, P3 could be adjusted to delay from the reference timing by necessity time duration.

Further, the waveform generation circuit 31 could store alternative pulse waveforms that include corresponding pulses P1, P2, P3 and necessity delay portions also. In this case, such pulse waveforms could be output at the same timing based on the clock signals, regardless of the volume of an ink droplet to eject.

What is claimed is:

1. An ink ejection device comprising:

a cavity plate formed with a pressure chamber and a nozzle;

an actuator that fluctuates an internal pressure of the pressure chamber to eject an ink droplet from the nozzle onto a recording medium; and a driving unit that selectively outputs a driving signal to the actuator, wherein the actuator fluctuates the internal pressure in response to the driving signal, the driving unit outputs the driving signal for ejecting a smaller ink droplet at a first timing earlier than a second timing for a larger ink droplet and a time difference t between the first timing and the second timing is represented by a formula:

$$t=g(1/\mathbf{V1}-1/\mathbf{V2})$$

where g is a distance between the nozzle and the recording medium;

V1 is a velocity of the smaller ink droplet; and

V2 is a velocity of the larger ink droplet.

2. The ink ejection device according to claim 1, wherein the time difference t is shortened in a tolerable range such that interference between an ink ejection for the larger ink droplet and an subsequent ink ejection for the smaller ink droplet due to residual pressure fluctuation is prevented.

3. An ink ejection device comprising:

a cavity plate formed with a pressure chamber and a nozzle;

an actuator that fluctuates an internal pressure of the pressure chamber to eject an ink droplet from the nozzle onto a recording medium; and a driving unit that selectively outputs a driving signal to the actuator, wherein the actuator fluctuates the internal pressure in response to the driving signal, the driving unit outputs the driving signal for ejecting a smaller ink droplet at a first timing earlier than a second timing for a larger ink droplet and the driving unit outputs a first pulse signal for the smaller ink droplet and a second pulse signal for the larger ink droplet, the first pulse signal having a first pulse for ejecting an ink droplet and a second pulse for downsizing the ink droplet ejected in response to the first pulse.

4. The ink ejection device according to claim 3, wherein the second pulse signal for the larger ink droplet includes a third pulse for ejecting an ink droplet and a fourth pulse for reducing residual pressure fluctuation in the pressure chamber after the ink droplet is ejected in response to the third pulse.

5. An ink ejection device comprising:

a cavity plate formed with a pressure chamber and a nozzle;

an actuator that fluctuates an internal pressure of the pressure chamber to eject an ink droplet from the nozzle onto a recording medium; and a driving unit that selectively outputs a driving signal to the actuator, wherein the actuator fluctuates the internal pressure in response to the driving signal, the driving unit outputs the driving signal for ejecting a smaller ink droplet at a first timing earlier than a second timing for a larger ink droplet and the driving unit outputs a first pulse signal for the smaller ink droplet and a second pulse signal for the larger ink droplet, the first pulse signal includes a first pulse followed by a second pulse with a first interval, the second pulse signal includes a third pulse followed by a fourth pulse with a second interval larger than the first interval, with the first pulse and the third pulse for ejecting an ink droplet.

6. The ink ejection device according to claim 5, wherein the first pulse is for ejecting an ink droplet, the second pulse is for downsizing the ink droplet ejected in response to the first pulse, the third pulse is for ejecting an ink droplet, and the fourth pulse is for reducing residual pressure fluctuation in the pressure chamber after the ink droplet is ejected in response to the third pulse.

7. The ink ejection device according to claim 6, wherein the driving unit further outputs a third pulse signal for a minute ink droplet smaller than the smaller ink droplet, the third pulse signal having a fifth pulse for ejecting an ink droplet and sixth pulse for downsizing the ink droplet ejected in response to the fifth pulse, and the driving unit outputs the third pulse signal at a third timing earlier than the first timing.

8. The ink ejection device according to claim 5, wherein the first pulse is for ejecting an ink droplet, the second pulse is for downsizing the ink droplet ejected in response to the first pulse, the third pulse is for ejecting an ink droplet, and the fourth pulse is for downsizing the ink droplet ejected in response to the third pulse.

* * * * *